US006287098B1

(12) United States Patent
Ahn et al.

(10) Patent No.: US 6,287,098 B1
(45) Date of Patent: Sep. 11, 2001

(54) MUFFLER FOR ROTARY COMPRESSOR

(75) Inventors: Byung Ha Ahn, Pusan-Kwangyokshi; Jang Woo Lee, Kyongsangnam-do; Young Jong Kim, Pusan-Kwangyokshi, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/390,667

(22) Filed: Sep. 7, 1999

(30) Foreign Application Priority Data

Dec. 17, 1998 (KR) ..... 98-55781

(51) Int. Cl.[7] ..... F03C 2/00
(52) U.S. Cl. ..... 418/63; 418/181
(58) Field of Search ..... 418/181, 63

(56) References Cited

FOREIGN PATENT DOCUMENTS 59-68590 * 4/1984 (JP) ..... 418/63
60-19984 * 2/1985 (JP) ..... 418/63
2-23291 * 1/1990 (JP) ..... 418/181
2-23292 * 1/1990 (JP) ..... 418/63
5-296176 * 11/1993 (JP) ..... 418/63
6-58283 * 1/1994 (JP) ..... 418/63
2000-18184 * 1/2000 (JP) ..... 418/63

* cited by examiner

*Primary Examiner*—Thomas Denion
*Assistant Examiner*—Theresa Trieu
(74) *Attorney, Agent, or Firm*—Fleshner & Kim, LLP

(57) ABSTRACT

Rotary compressor including a main bearing having a discharge passage for discharging compressed gas and a boss for inserting a motor shaft, the main bearing forming a component of a compression chamber, and a muffler having a boss hole for passing the boss of the main bearing and a discharge opening for discharging the compressed gas, the muffler mounted on the main bearing, wherein the discharge opening in the muffler is formed at least one in number inside of the discharge passage in the main bearing, whereby attenuating a noise generated in operation of the rotary compressor, effectively.

12 Claims, 8 Drawing Sheets

Section I – I

MUFFLER FOR ROTARY COMPRESSOR

BACKGROUND OF THE INVENTION

1. Field of the Invention

The present invention relates to a rotary compressor, and more particularly, to a muffler for attenuating a noise generated in operation of a rotary compressor.

2. Background of the Related Art

The compressor for compressing air or gas to a required pressure is used in an air conditioner or the like for compressing a refrigerant gas to a required pressure.

A related art rotary compressor will be explained with reference to FIGS. 1 and 2.

The related art rotary compressor is provided with a hermetic case 1 having a suction pipe 16 for drawing refrigerant and a discharge pipe 5 for discharging the compressed refrigerant, both connected thereto, a driving unit 6 in the case 1 for providing a rotating force, and a compression unit 10 for compressing gas. The driving unit 6 has a stator 2 and a rotor 3 of a motor mounted on an upper portion in the case 1. The rotor 3 is coupled to a shaft 4 for transmission of a rotating power to the compression unit 10. The rotor 3 has an eccentric portion 4*a* at a lower portion thereof. The compression unit 10 has a compression chamber 'C' enclosed by a cylinder 11 forming a wall of the compression chamber 'C', and a main bearing 14 and a supplementary bearing 15 mounted at an upper side and a lower side of the compression chamber 'C' respectively. The compression chamber 'C' has the suction pipe 16 connected thereto for receiving refrigerant from outside of the compression chamber 'C'. The cylinder 11 and the main bearing 14 have a discharge opening 11*a* and a discharge passage 14*b* formed therein respectively for discharging refrigerant, which discharge passage 14*b* is opened/closed by a valve (not shown). In the meantime, the eccentric portion 4*a* of the shaft is mounted in the compression chamber 'C', i.e., inside of the cylinder 11. There is a roller 12 fitted to an outside of the eccentric portion 4*a* for making a compression action as the eccentric portion 4*a* keeps making contact with an inside surface of the cylinder 11 following rotation of the eccentric portion 4*a*. And, there is a vane 13 mounted in the cylinder 11 to be always in contact with an outside of the roller 12 biased by a spring for dividing the compression chamber 'C' into a high pressure portion and a low pressure portion. There is a muffler 20 above the main bearing 14 for attenuation of noise, which has a muffler discharge opening 21 for discharging a compressed gas received from a cylinder discharge opening 11*a* to an inside of the case 1.

The muffler will be explained with reference to FIGS. 3A and 3B.

The muffler 20 in a form of a cap has a boss hole 22 for passing a boss portion 14*a* of the main bearing 14, and recessed bolt fixing parts 23 in an outer circumference thereof for fastening the muffler 20 to the main bearing 14. The muffler 20 has a muffler discharge opening 21 for discharging the compressed gas flowed into the muffler 20, formed in outer periphery spaced from the boss hole 22.

The operation of the related art rotary compressor will be explained with reference to FIGS. 1 and 2.

Upon starting the rotary compressor, the rotor 3 of the motor is rotated, to rotate the eccentric portion 4*a* of the shaft, eccentrically rotating the roller 12 inside of the cylinder 11 in a state the roller 12 is in contact with the vane 13. The eccentric rotation of the roller 12 reduces a volume of the compression chamber 'C', compressing low pressure refrigerant flowed into the compression chamber 'C' through the suction pipe 16 to a required pressure. The compressed high pressure refrigerant is discharged into the muffler 20 above the main bearing 14 through the cylinder discharge opening 11*a* and the discharge passage 14*b* of the main bearing, following operation of the valve. The high pressure refrigerant thus discharged into the muffler 20 is discharged into an inside of the case 1 through the muffler discharge opening 21. And the high pressure refrigerant discharged into inside of the case 1 is discharged outside of the rotary compressor through the discharge pipe 5 on top of the case 1 through gaps between the rotor 3 and the stator 2 or the case 1 and the stator 2.

FIG. 4 illustrates a pressure distribution in the muffler calculated according to a numerical analysis method, and FIG. 5 illustrates a kinetic turbulent energy distribution calculated according to the numerical analysis method, referring to which a flow state of the compressed refrigerant inside of the muffler 20 will be explained.

As can be known from FIGS. 4 and 5, though there is a small pressure distribution variation in overall in the muffler 20, a kinetic turbulent energy distribution exhibited has a great variation. Though the pressure affects a performance of the compressor, the kinetic turbulent energy affects to a noise of the compressor. This is because the kinetic turbulent energy is a velocity energy which is a square of a velocity, and, though a fluid noise is functions of pressure variation, speed variation, and density variation, the pressure variation and the density variation affects to the noise little, but the velocity variation is proportional to the noise generation, mostly.

That is, as shown in FIG. 5, it can be known that, though there is a slight variation of kinetic turbulent energy around the boss hole 22 in the related art muffler 20, there is a great variation of kinetic turbulent energy as it goes to an outer circumference of the muffler where the muffler discharge opening is positioned, that increases the noise.

The reason why there is a great variation of the kinetic turbulent energy in the vicinity of the muffler discharge opening 21 will be explained.

The gas compressed in the compression chamber 'C' is discharged from the compression chamber 'C' to the muffler 20 in a turbulent state at a fixed average speed. Therefore, the gas discharged into the muffler 20 has a centrifugal force exerted thereon from the average speed and a discharge speed, to form a main flow at an outer circumference of the muffler 20, with an increased gas speed. That is, as the compressed gas flows from an inner circumference to the outer circumference of the muffler 20, a gas flow speed is increased by the inertia until the gas is discharged through the muffler discharge opening 21 formed in the vicinity of the outer circumference of the muffler 20, that causes much noise.

Therefore, because the refrigerant flowed in the muffler has not an even kinetic turbulent energy distribution and is discharged outside of the muffler 20 through the muffler discharge opening 21 without consumption of much of the velocity energy, the refrigerant is involved in little amount of a pressure fluctuation and a speed reduced in the muffler 20. Thus, the related art muffler has a poor noise reduction performance, and shows a directional noise generation pattern according to a position of the muffler discharge opening.

SUMMARY OF THE INVENTION

Accordingly, the present invention is directed to a muffler that substantially obviates one or more of the problems due to limitations and disadvantages of the related art.

An object of the present invention is to provide a muffler for a rotary compressor which can improve a noise attenuation function.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the rotary compressor including a main bearing having a discharge passage for discharging compressed gas and a boss for inserting a motor shaft, the main bearing forming a component of a compression chamber, and a muffler having a boss hole for passing the boss of the main bearing and a discharge opening for discharging the compressed gas, the muffler mounted on the main bearing, wherein the discharge opening in the muffler is formed at least one in number inside of the discharge passage in the main bearing.

The discharge opening in the muffler is preferably a portion of the boss hole enlarged as a unit.

The boss preferably has an opening for discharging the compressed gas at a position opposite to the discharge opening in the muffler.

The discharge opening in the muffler is preferably formed at a position opposite to the discharge passage in the main bearing.

Accordingly, the muffler for a rotary compressor of the present invention can attenuate noise, effectively.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
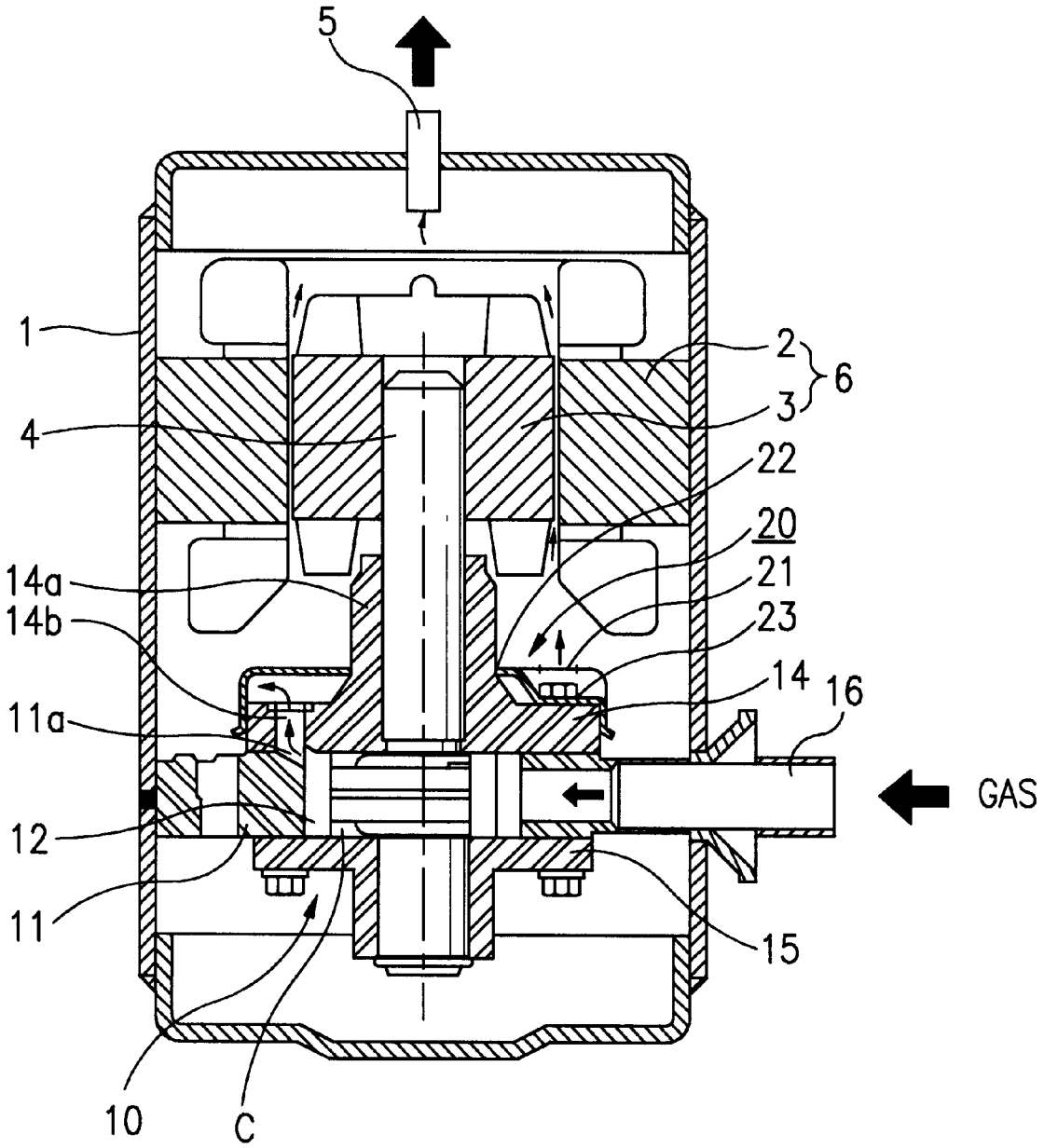
FIG.1 Related Art
FIG. 1 illustrates longitudinal section of a related art rotary compressor.
Figure 2:
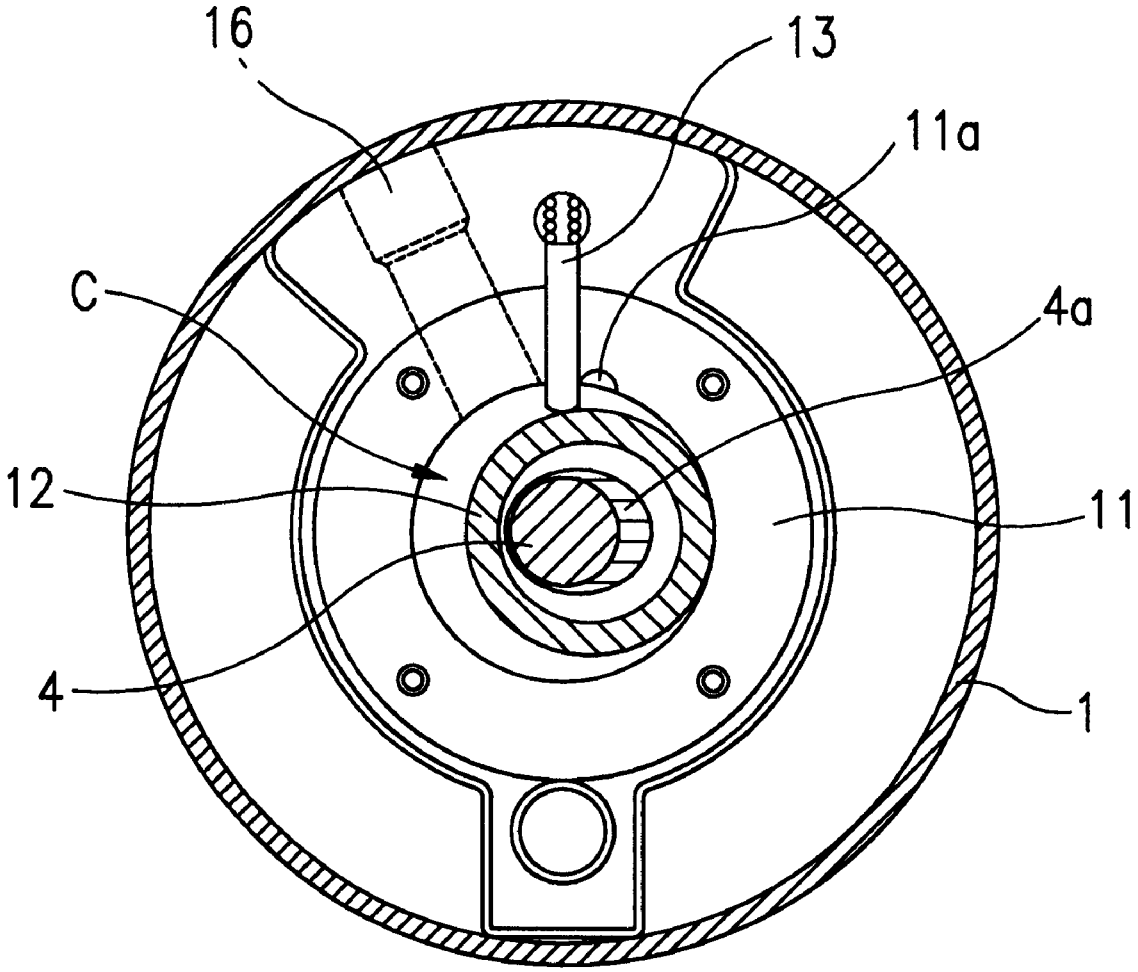
FIG.2 Related Art
FIG. 2 illustrates transverse section of the related art rotary compressor.
Figure 3A:
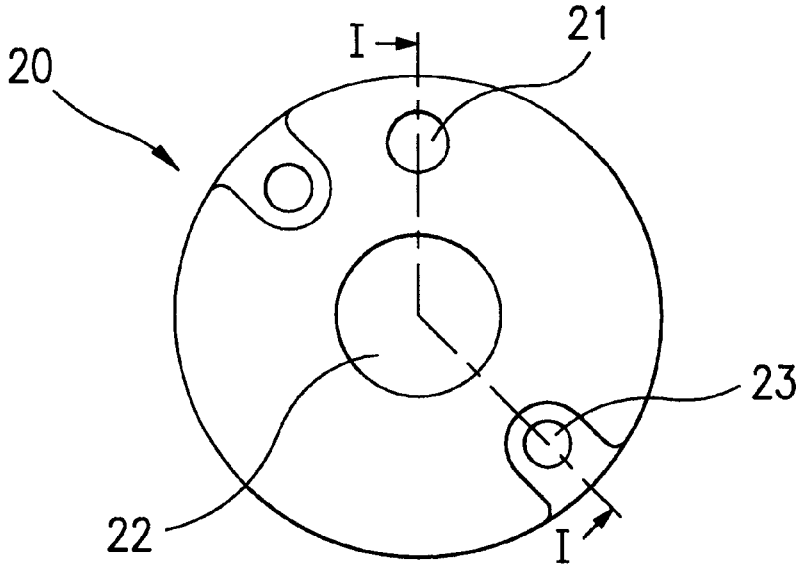
FIG.3A Related Art
FIGS. 3A and 3B illustrate a plan view and a sectional view across line I—I of a related art muffler for a rotary compressor, respectively.
Figure 3B:
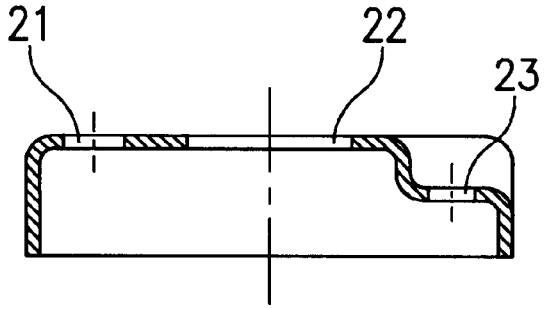
FIG.3B Related Art
Figure 4:
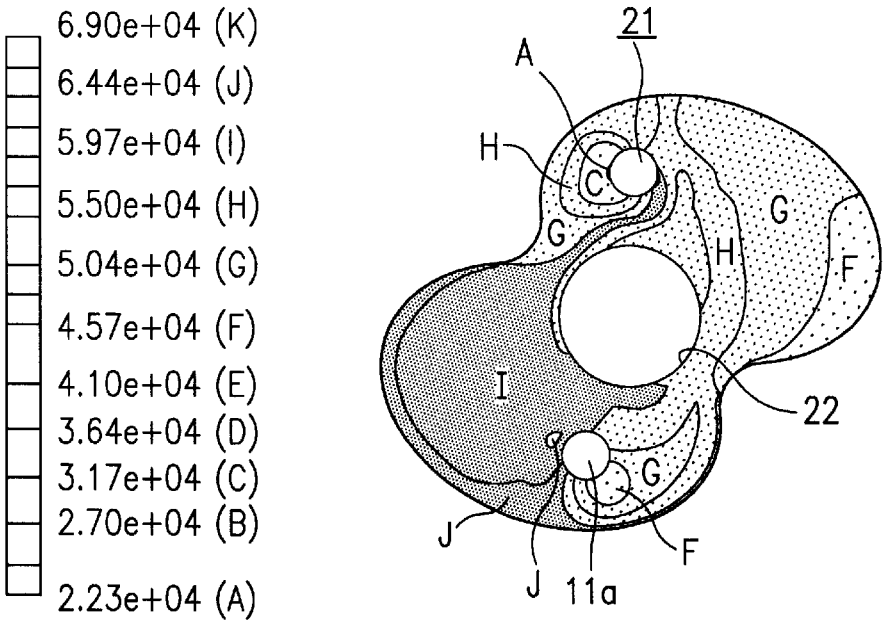
FIG.4 Related Art
FIG. 4 illustrates a pressure distribution in the muffler calculated according to a numerical analysis method.
Figure 5:
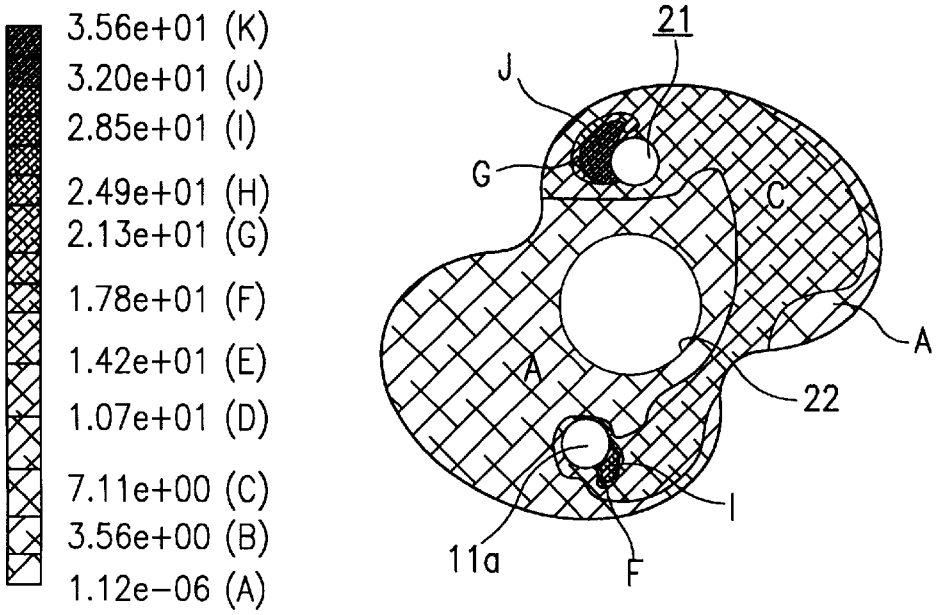
FIG.5 Related Art
FIG. 5 illustrates a kinetic turbulent energy distribution calculated according to the numerical analysis method.
Figures 6A, 6B:
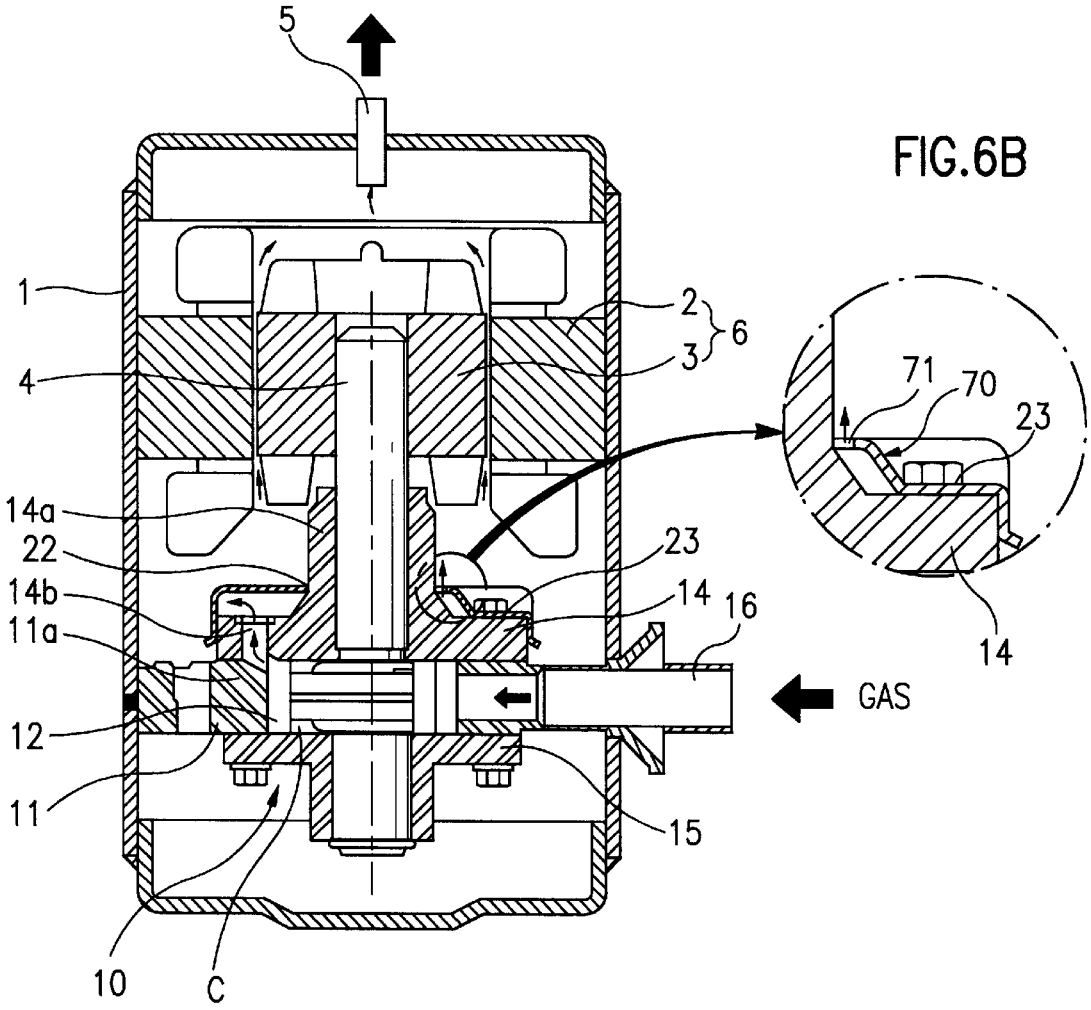
FIGS. 6A and 6B illustrate a section of a muffler for a rotary compressor in accordance with a first preferred embodiment of the present invention.

Reference will now be made in detail to the preferred embodiments of the present invention, examples of which are illustrated in the accompanying drawings. FIGS. 6A and 6B illustrate a section of a muffler for a rotary compressor in accordance with a first preferred embodiment of the present invention. Components identical to the related art will be given identical names and reference symbols, and detailed explanations for the same will be omitted.

Figure 7A:
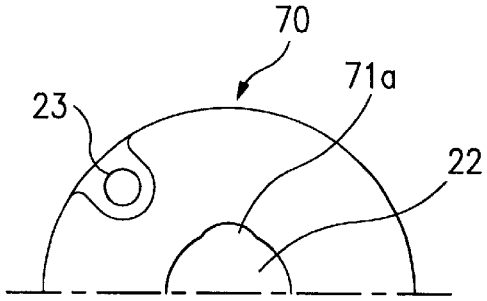
FIGS. 7A~7E illustrate plan views of different variations of a muffler for a rotary compressor in accordance with a first preferred embodiment of the present invention.
Figure 7B:
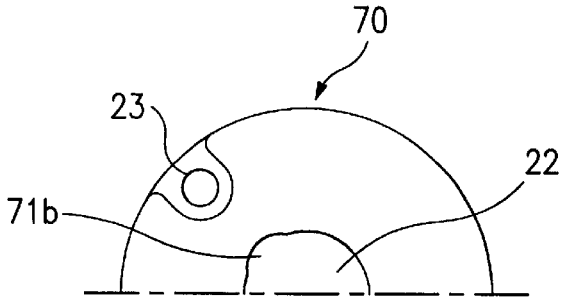
Figure 7C:
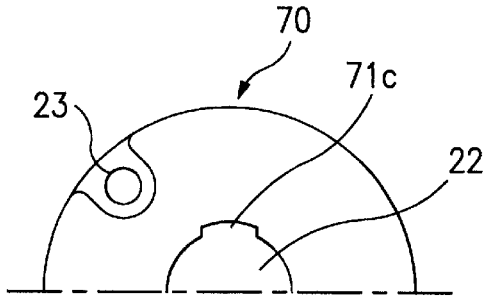
Figure 7D:
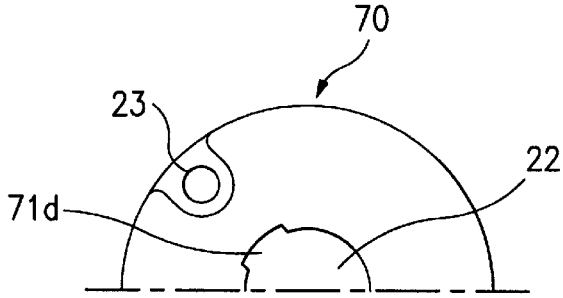
Figure 7E:
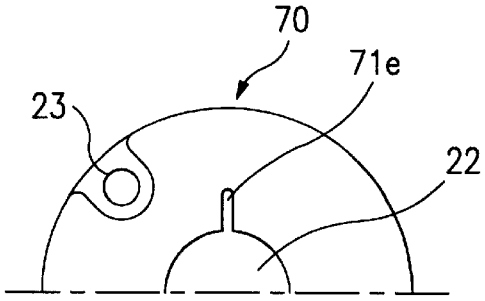

Entire structure of the rotary compressor of the present invention is identical to the related art rotary compressor, except that a structure of a muffler provided for attenuating a noise in compressed gas discharge is different from the same of the related art. That is, the muffler of the present invention has a structure in which a velocity energy of the refrigerant discharged from the compression chamber 'C' is consumed effectively in the muffler before the refrigerant is discharged outside of the muffler. In detail, the muffler 70 of the present invention has a form of a cap with a boss hole 22 for passing a boss portion 14*a* of a main bearing 14 and a bolt fixing parts 23 at one side thereof. However, a structure of the muffler discharge opening 71 for discharging high pressure gas flowed in inside of the muffler 70 to an inside of the case 1 is different from the same of the related art. That is, the muffler discharge opening 71 is a portion of the boss hole 22 in the muffler 70 enlarged to a required form. The muffler discharge opening 71 may be plural, and preferably positioned opposite to the discharge passage 14*b* in the main bearing 14. And, as shown in FIGS. 7A and 7B, the muffler discharge opening may be semicircular 71*a* of 71*b*, as shown in FIGS. 7C and 7D, the muffler discharge opening may be an elongated along a circumference, or, as shown in FIG. 7E, the muffler discharge opening may be a slot 71*e*. Other forms than the foregoing forms of the muffler discharge opening may be used. Of course, the muffler discharge opening 71 may be formed by reducing a portion of an outside surface of the boss portion 14*a* of the main bearing 14, for discharging refrigerant gas close to a center portion of the muffler as far as possible by forming the muffler discharge opening using both the muffler 70 and the main bearing 14.

Figure 8:
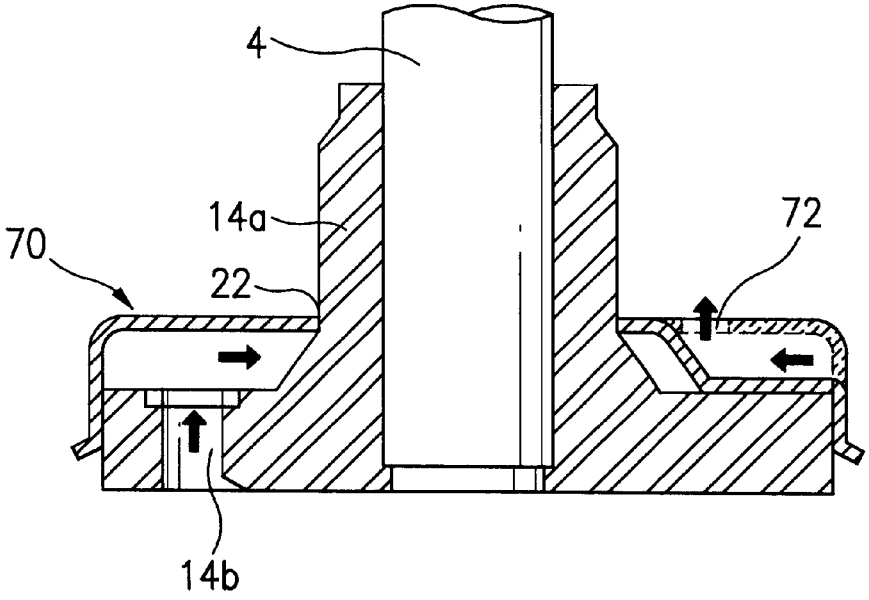
FIG. 8 illustrates a section of a muffler for a rotary compressor in accordance with a second preferred embodiment of the present invention.
Figure 9:
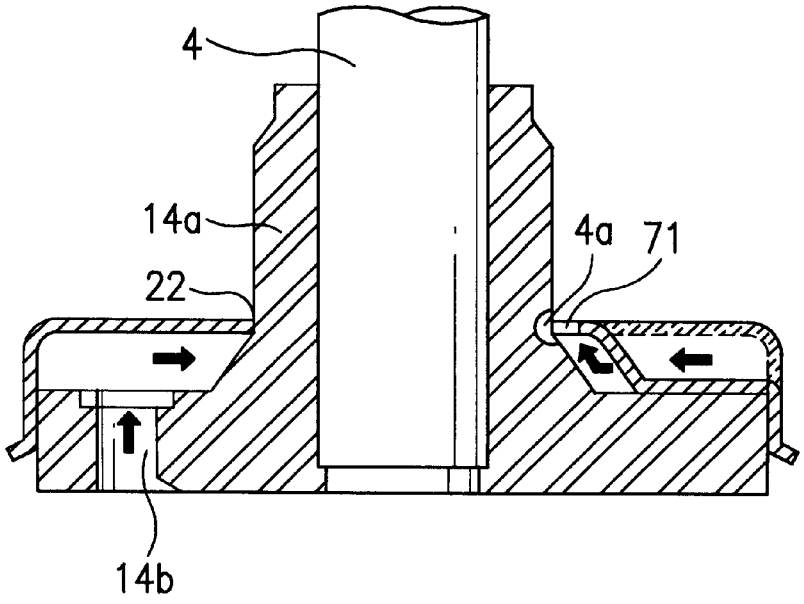
FIG. 9 illustrates a section of a muffler for a rotary compressor in accordance with a third preferred embodiment of the present invention.

Though the muffler discharge opening 71 is formed by enlarging a portion of the boss hole 22 of the muffler, i.e, the boss hole 22 and the muffler discharge opening 71 is formed as a unit in the foregoing embodiment, the present invention is not limited to this. That is, as shown in FIG. 8, the muffler discharge opening 72 may be formed at a position more inside, i.e., closer to the boss hole 22 than the discharge passage 14*b* in the main bearing 14. The muffler discharge opening 72 is preferably formed closer to the boss hole 22 of the muffler 70 as far as possible. Or as shown in FIG. 9, a portion of the boss 14*a* of the main bearing 14 is cut away to form an opening 4*a* for discharging the refrigerant in the muffler therethrough. Use of the opening 4*a* and the muffler discharge opening 71 as a unit is also possible, for discharging the refrigerant gas closer to a center portion of the muffler as far as possible by forming the refrigerant discharge opening in the muffler 70 and in the main bearing 14 as a unit.

The operation of the muffler for a rotary compressor of the present invention will be explained with reference to FIGS. 6A and 6B.

Refrigerant compressed in the compression chamber 'C' flows into the muffler 70 through the cylinder discharge opening 11*a* and the discharge passage 14*b* in the main bearing 14. The gas flowed in the muffler 70 flows toward the outer circumference of the muffler by inertia, with gradual consumption of the velocity energy. In a state the kinetic turbulent energy is reduced at the outer circumference of the muffler 70, the compressed gas flows toward the inner circumference again, to consume the kinetic turbulent energy further, until the refrigerant gas is discharged through the muffler discharge opening 71 close to the boss portion 14*a* in the bearing 14.

The muffler for a rotary compressor of the present invention has the following advantage.

The muffler for a rotary compressor of the present invention can effectively attenuate noise generated during operation of a rotary compressor.

Figure 10A:
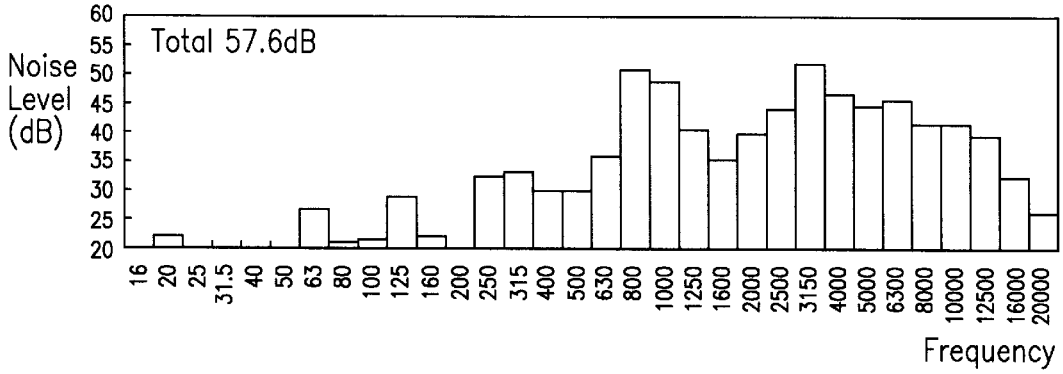
FIG.10A Related Art
FIGS. 10A and 10B illustrate spectrum graphs of measured noise levels of the mufflers of the related art and of the present invention.
Figure 10B:
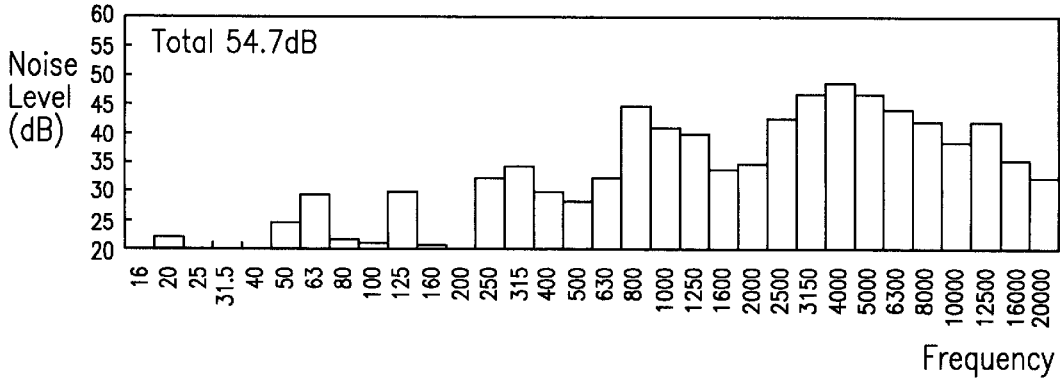

The advantage can be verified by experimental data shown in FIGS. 10A and 10B. FIG. 10A illustrates a spectrum graph of noise levels of the related art muffler, and FIG. 10B illustrates a spectrum graph of noise levels of the muffler of the present invention. FIG. 10B is based on the muffler discharge opening 71*a* shown in FIG. 7A. Referring to which, it can be known that a total noise level in the related art is 57.6 dB, and the same in the present invention is 54.7 dB, with about 3 dB reduction from the related art. In conclusion, because the refrigerant is discharged to outside of the muffler 70 through the muffler discharge opening 71 in a state a pressure fluctuation and a kinetic turbulent energy are reduced, a noise coming from discharge of the compressed refrigerant can be attenuated, and the directional noise generation pattern can be reduced.

It will be apparent to those skilled in the art that various modifications and variations can be made in the muffler for a rotary compressor of the present invention without departing from the spirit or scope of the invention. Thus, it is intended that the present invention cover the modifications and variations of this invention provided they come within the scope of the appended claims and their equivalents.

What is claimed is:

1. A rotary compressor, comprising:

a main bearing forming a component of a compression chamber and having a main gas discharge passage for discharging compressed gas, and a boss for inserting a motor shaft; and a muffler mounted on the main bearing and having an aperture for passing the main bearing, and a gas discharge opening, wherein the gas discharge opening in the muffler comprises an enlargement of the aperture for passing the main bearing, wherein the gas discharge opening is semicircular.

2. A rotary compressor, comprising:

a main bearing forming a component of a compression chamber and having a main gas discharge passage for discharging compressed gas, and a boss for inserting a motor shaft; and a muffler mounted on the main bearing and having an aperture for passing the main bearing, and a gas discharge opening, wherein the gas discharge opening in the muffler comprises an enlargement of the aperture for passing the main bearing, wherein the gas discharge opening is elongated along a circumference of the aperture.

3. The rotary compressor of claim 2, wherein the gas discharge opening is formed in the muffler at a position opposite to the main gas discharge passage.

4. The rotary compressor of claim 2, wherein the gas discharge opening is semicircular.

5. The rotary compressor of claim 2, where the gas discharge opening is slot shaped.

6. A rotary compressor, comprising:

a main bearing forming a component of a compression chamber and having a main gas discharge passage for discharging compressed gas, and a boss for inserting a motor shaft; and a muffler mounted on the main bearing and having an aperture for passing the main bearing, and a gas discharge opening, wherein the gas discharge opening in the muffler comprises an enlargement of the aperture for passing the main bearing, wherein the gas discharge opening is slot shaped.

7. A muffler for a rotary compressor, comprising:

a muffler plate configured to be attached to a bearing of the rotary compressor, wherein the muffler plate includes a gas discharge opening which comprises an enlargement of an aperture configured to surround the bearing of the compressor, wherein the gas discharge opening is semicircular.

8. A muffler for a rotary compressor, comprising:

a muffler plate configured to be attached to a bearing of the rotary compressor, wherein the muffler plate includes a gas discharge opening which comprises an enlargement of an aperture configured to surround the bearing of the compressor, where the gas discharge opening is elongated along a circumference of the aperture.

9. The muffler of claim 8, wherein the muffler also includes a main gas discharge hole, and wherein the gas discharge opening is formed in the muffler at a position opposite to the main gas discharge hole.

10. The muffler of claim 8, wherein the gas discharge opening is semicircular.

11. The muffler of claim 8, where the gas discharge opening is slot shaped.

12. A muffler for a rotary compressor, comprising:

a muffler plate configured to be attached to a bearing of the rotary compressor, wherein the muffler plate includes a gas discharge opening which comprises an enlargement of an aperture configured to surround the bearing of the compressor, where the gas discharge opening is slot shaped.

* * * * *